US005292101A

United States Patent [19]

Henson

[11] Patent Number: 5,292,101

[45] Date of Patent: Mar. 8, 1994

[54] LOCKABLE LEVELING STRUCTURE

[76] Inventor: Robert M. Henson, 8170 State Highway 208, San Angelo, Tex. 76905

[21] Appl. No.: 804,290

[22] Filed: Dec. 9, 1991

[51] Int. Cl.[5] ..... A47G 33/00

[52] U.S. Cl. ..... 248/526; 248/188.2; 248/528

[58] Field of Search ..... 248/526, 525, 523, 528, 248/527, 524, 170, 188.2; 47/40.5

[56] References Cited

U.S. PATENT DOCUMENTS

| | | | |
|---|---|---|---|
| 594,491 | 11/1897 | Silverman | 248/528 X |
| 1,028,787 | 6/1912 | Rossmeissl | 248/527 X |
| 2,014,896 | 9/1935 | Hollander | 248/525 |
| 3,045,959 | 7/1962 | Herrington | 248/528 X |
| 3,473,771 | 10/1969 | Newman | 248/526 X |
| 3,480,250 | 11/1969 | Hankins | 248/170 X |
| 3,661,349 | 5/1972 | DeVries | 248/527 X |
| 4,923,156 | 5/1990 | Linnéusson | 248/170 |

FOREIGN PATENT DOCUMENTS

| | | | |
|---|---|---|---|
| 186819 | 1/1922 | United Kingdom | 248/526 |

*Primary Examiner*—Karen J. Chotkowski

[57] ABSTRACT

A lockable leveling structure has a vertical stand with a base at one end. The stand has legs pivotally attached and can be locked in a stable manner by a slide collar and thumb screw. The slide collar is movable about the vertical stand and makes a solid contact against the end of the legs causing the outer end of the legs to move up or down respective to one another to compensate for an unlevel support surface. This provides a solid motionless structure that can carry a load bearing fixture in desired degree of levelness in a safe, stable, novel manner without the use of shims, or altering the surface while on unlevel surfaces. The slide collar is unlocked and raised up the stand member allowing the bottom of the legs to rotate up toward the vertical stand member causing the structure to be in a compact package for storage or transport.

17 Claims, 2 Drawing Sheets

FIG. 1
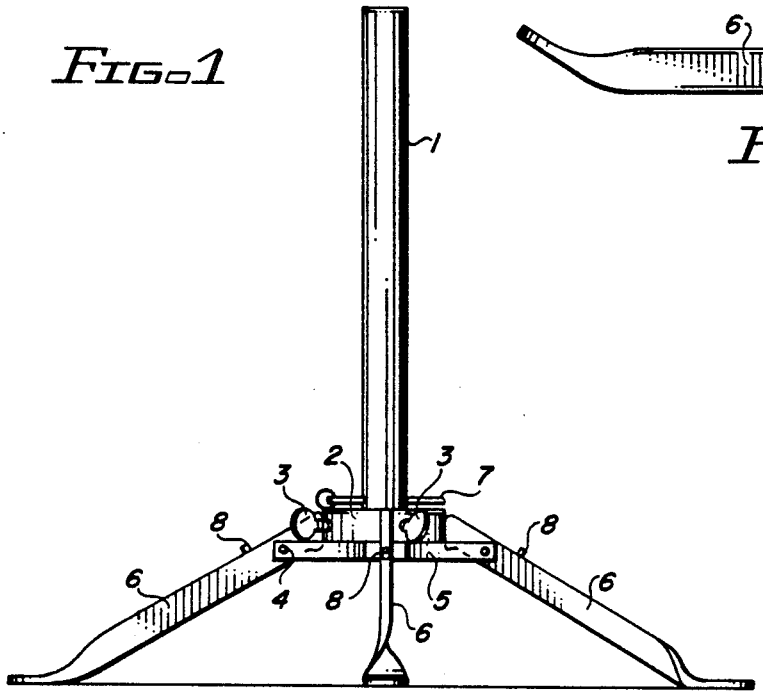
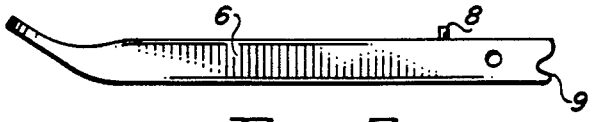
FIG. 5
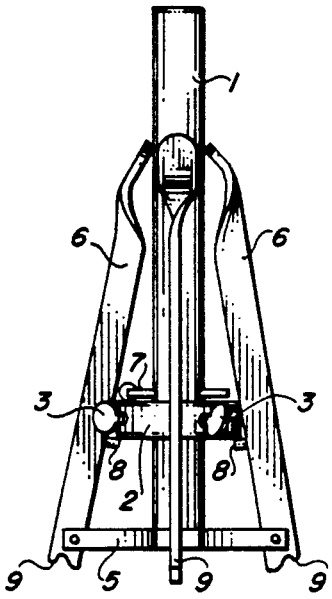
FIG. 7
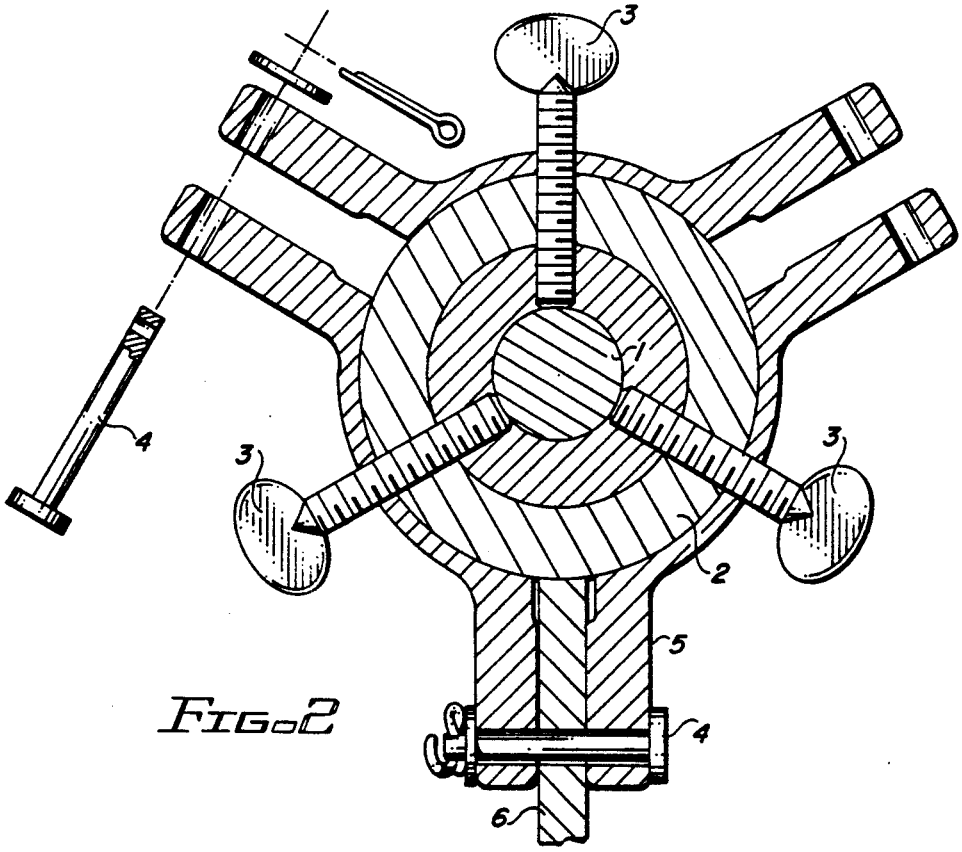
FIG. 2

FIG. 3
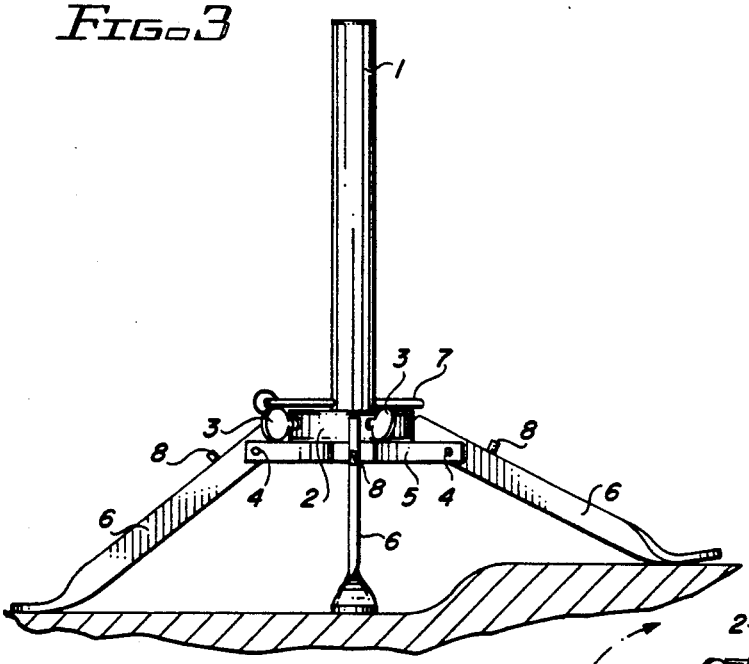
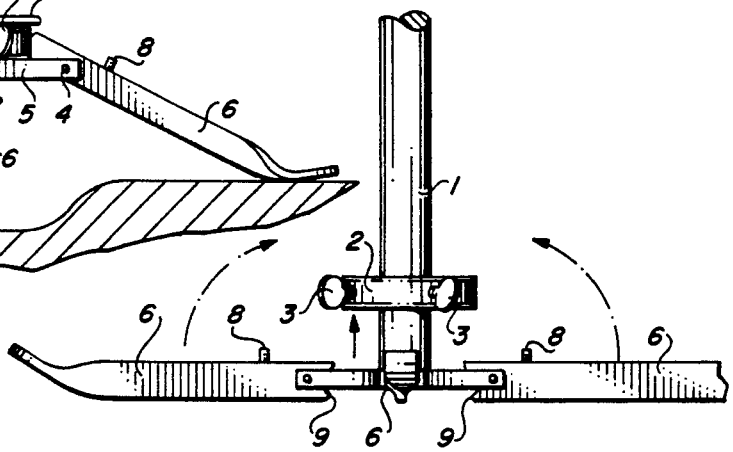
FIG. 6
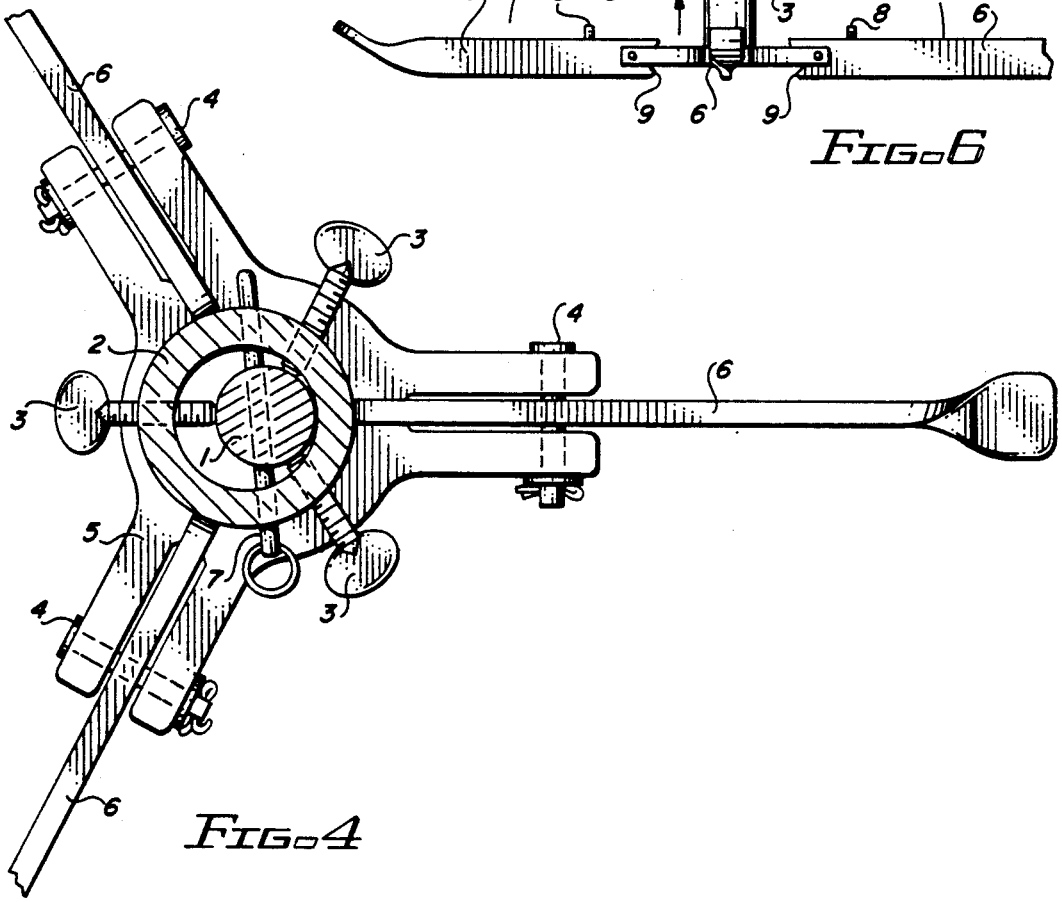
FIG. 4

LOCKABLE LEVELING STRUCTURE

BACKGROUND OF THE INVENTION

Heretofore lockable leveling structures had to be shimmed to make a solid, stable structure, and no known structure exists that holds the load perpendicular to the base when placed on uneven surfaces. Those skilled in the art can appreciate the unique difference, safety, and versatility of this invention, when viewing Henson, U.S. Pat. No. 4,836,332; Shapiro, U.S. Pat. No. 5,007,502; Ina, U.S. Pat. No. 4,533,103 and Hoffman, U.S. Pat. No. 4,482,118. In Henson, U.S. Pat. No. 4,836,332, the toggle assembly is similar, but offers no positive way of leveling on uneven surfaces. In Shapiro, U.S. Pat. No. 5,007,502, the load is not transmitted in a stable fashion and will cause the horse to fall over. In Ina, U.S. Pat. No. 4,533,103, the difference is that the leveling is limited to only two directions and it would not survive heavy loads. In Hoffman, U.S. Pat. No. 4,482,118, the entire mechanism is too time consuming, and the load is not perpendicular to the main base when on uneven surfaces.

The present invention differs from the known prior art, by the provision of a base that can be easily folded into a compact package and upon unfolding can provide a stable angle for a load bearing fixture, while being on an uneven support surface, such as the ground. This invention therefore relates to a novel way of leveling a load carrying fixture.

SUMMARY OF THE INVENTION

A leveling structure by which a load can be supported from a surface in a level altitude. The structure comprises a base, a stand member attached to said base and upwardly extending therefrom for carrying a load thereon, and an annular slide collar having a central passageway and an outer cam surface. The stand member is slidably received in captured relationship through the annular slide collar passageway, and fastener means are provided by which the collar is fixed respective to said stand member and base. Support legs are affixed to the base.

Said base has a radial slot formed therein within which one of a plurality of said legs is pivotally received, with each leg being placed circumferentially about said base. Each leg has a near end opposed to a far end, with the far end of said legs extending radially from said base. Means pivotally mount the marginal near end of each said leg within said slot to transfer loads from the legs into the stand and also to enable said legs to pivot from a lowermost position (where the legs downwardly extend at an angle) into an uppermost position (where the legs are substantially parallel to said stand). The near end of each leg terminates in a cam face which abuttingly engages the slide collar, while the far end of the leg terminates in a foot for engaging the ground.

Accordingly, a primary object of the present invention is the provision of a leveling structure that provides a safe, sturdy, stable means of support for a load while setting on uneven surfaces.

Another object of the invention is to provide the user with a structure that has legs or appendages that can be folded onto itself to make a small package without the necessity of removing any of the parts from the structure.

A still further object of the present invention is the provision of a leveling structure that provides a stable means of support for a load while setting on uneven surfaces by the provision of a base having a stand affixed thereto that telescopingly receives an annular locking collar slidably positioned thereon to engage the curved end of a plurality of legs and lock the legs into a selected position that results in the stand being oriented in a selected position respective to the supporting surface.

A further object of this invention is to provide the user with a durable, uncomplicated, light weight, speedy, nonstrenuous, ecology unaltering leveling device wherein the terrain does not have to be disturbed in order to achieve a desired angle of levelness.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated as described herein.

BRIEF DESCRIPTION OF THE DRAWINGS

FIG. 1 is a broken, side view of my lockable leveling structure;

FIG. 2 is a partial cross-sectional view taken along line 2—2 of FIG. 1;

FIG. 3 is a side view of my invention shown in operation on an unlevel surface;

FIG. 4 is a part cross-sectional view taken along line 4—4 of FIG. 3 showing details of my lockable leveling structure, with the leveling mechanism compensating for the unlevel surface in FIG. 3;

FIG. 5 is a detailed plan view showing a detail of a leg member of the foregoing figures;

FIG. 6 is a side view showing the apparatus of FIGS. 1 and 3 partially folded; and, FIG. 7 is a side view of the invention folded up and locked in transport position.

CATALOG OF PARTS

1 stand member
2 slide collar
3 locking device (thumb screws)
4 pin
5 base, unitary but can be three identical pieces
6 radially extending leg
7 safety pin
8 dog
9 dog notch
10 lockable leveling structure
12 slot in base
14 axial hole in collar
16 central axis
18 feet at far end
20 curved near end; cam
22 marginal near end

DETAILED DESCRIPTION OF THE PREFERRED EMBODIMENT

The figures of the drawings disclose a lockable leveling structure made in accordance with the present invention. As seen in FIG. 1, the structure has a stand member 1 which preferably is a piece of round tubing. A base 5 and lockable slide collar mechanism 2 is attached to the lower end of stand member 1. As seen in FIG. 2, the base member 5 provides a means of support for stand member 1 and radially extending leg members 6. The base 5 can be of various shape, size, and material as long as it is suitable to carry the anticipated loads.

A slide collar 2 has a hole formed axially therethrough for telescopingly receiving stand member 1 therein. The axial hole is substantially larger than the outside diameter of the stand member in order to provide adequate clearance for sufficient movement about member 1; i.e.: the slide collar 2 can wobble and oscillate respective to the stand member 1. The slide collar 2 is preferably an annular member and has means of being locked into a preferred or selected position by means of a locking device 3, shown herein as thumb screws. The number of thumb screws preferably is three, but any reasonable number can be employed so long as it can stabilize the slide collar 2 in relation to stand member 1.

The base 5 provides a means by which the near ends of legs or appendages 6 are pivotally mounted by a pin 4 or other suitable means. A dog 8 is formed on each of the legs 6 in the illustrated manner of FIG. 5 to provide a means of holding each of the legs 6 folded while in transport. The dog 8 makes contact with the bottom side of the slide collar 2 as shown in FIG. 7, and this can be an optional feature. The dog notch 9 of FIG. 5 contacts the bottom side of the slide collar 2 when the leg 6 is in the operational position set forth in FIGS. 1 and 3 if the entire structure is raised off the support surface for relocation. The dog notch 9 limits the downward movement of the lower end or foot of the leg 6. This provides a means of limiting the downward movement, which can also be accomplished by positioning the dog 8 on the side of the leg 6, hence the dog notch 9 is an optional means of achieving this result.

The base 5 of FIGS. 2 and 4 has a slot formed therein for pivotally receiving the near marginal end of the legs 6. The slot is preferably made deep enough to allow the near marginal end of the leg to pass therethrough and into the position set forth in FIG. 7. Hence, when the apparatus is moved into and out of the folded position, the slide collar 2 is raised to allow passage of the near end of the leg as noted in FIGS. 6 and 7.

OPERATION

In operation, the lockable leveling structure of FIGS. 1 and 3 are conveniently transported in the folded configuration of FIG. 7 to the location where needed. The load bearing fixture can be mounted to member 1 before or after arrival. The structure is placed on the selected support surface, (i.e., the ground or the floor), the safety pin 7 of FIG. 7 is removed to allow the slide collar 2 FIG. 6 to be raised or telescoped up member 1. This allows the dogs 8 of FIGS. 5, 6 and 7 and member 9 to release the legs 6 letting them pass through the radial slot 5 in the base as seen in FIG. 6. This releases the collar 2 which is allowed to rest on the upper edge of the legs 6. The structure is raised vertically while the far end of the legs 6 remain in contact with the surface during this pivotal action, whereupon the near ends of the legs rotate about the pin and raise up through the radial slots 12 in the base 5. This widens the distance from the legs 6 and stand member 1 as the legs move apart, allowing the slide collar 2 to rest upon the base 5. The structure is then released and allowed to stand upright, then the safety pin 7 is reinstalled to make sure the slide collar 2 cannot raise off the base 5. Then the user can attain the desired angle of levelness by pushing the stand member 1 to desired angle, which results in a lateral movement of the slide collar 2 respective to the stand member 1; i.e., the vertical axis of the stand member moves laterally respective the vertical axis of the collar hole. The unlevelness of the surface the structure sets on is therefore compensated by the upward and downward movement of the upper and lower ends of the legs 6 as shown in FIGS. 3 and 4. The slide collar 2 resists the compressive load generated by the abutting cam or near end of the legs 6 as the slide collar 2 makes full contact with the upper end of each of the legs 6. Then the locking devices are forced against stand member 1. This locks the slide collar 2 to stand member 1 which allows no movement of any part of the structure. This is better understood while viewing FIGS. 3 and 4 of the drawings.

The amount of leg 6 compensation of an unlevel surface is directly related to the amount of clearance allowed between the slide collar 2 and the stand member 1. FIG. 4 shows the slide collar 2 against stand member 1, and this indicates the amount of compensation of an unlevel surface being at the maximum for that legs 6.

In order to store and transport the lockable leveling structure, simply pull safety pin 7, withdraw the locking devices 3 from contact with stand member 1, raise slide collar 2, set the structure on a suitable surface, fold the legs 6 inwardly toward member 1, let the slide collar 2 rest on the base 5, reinstall the safety pin 7, and the structure is ready for storage or transport.

Those skilled in the art, having digested this disclosure, will appreciate while the above description contains many specifications which should not be construed as limitations on the scope of the invention, but rather as an exemplification of one preferred embodiment thereof. Many other variations are possible. For example, this invention can be made in various sizes and capacities to accommodate the anticipated loads that it may be required to handle.

This invention has a small number of parts, and each part can be made in correlation with any engineering requirement to attain the same results, size, shape, weight, materials, number of components, method of manufacture, and above all safety and ecology compatibility.

I claim:

1. A lockable leveling structure having a stand member supported by a base, said stand member having a vertical central axis; a leveling and locking means by which said stand member can be adjusted respective to said vertical axis; said leveling and locking means includes a slide collar which has an aperture which and telescopingly receives said stand member in a slidable manner; a plurality of radial slots positioned about a central axis of said base and outwardly extending therefrom;

a plurality of legs having a near end opposed to a far end, cam means on the near end of each of said legs, means pivotally receiving one of said plurality of legs within a respective slot, said legs being foldable toward said stand from a load bearing configuration to a retracted configuration which presents a small compact package;

said slide collar has an outer wall surface that engages the cam means on the near end of said legs to abuttingly engage and arrest pivotal movement of the legs when pivoting upwardly, means by which said slide collar is locked into position to fix the position of said legs respective to said stand.

2. The lockable leveling structure of claim 1 wherein the aperture in said slide collar is of a configuration for said collar to move laterally respective to said stand member and to pivotally move and lock said legs in a load bearing configuration and thereby provide a stable load bearing support on an unlevel surface.

3. The lockable leveling structure of claim 1 wherein said cam means on the terminal near end of said legs is curved, and is spaced respective to the slot, stand member, and slide collar to bring the outer surface of the slide collar into abutting engagement with the curved near end of the legs and thereby fix the legs into a selected position respective to the stand member, and provide means of leveling a load carried by the stand member.

4. The lockable leveling structure of claim 1 wherein the slide collar aperture is of a size significantly larger than said stand member to enable said collar to be moved laterally respective to the stand member to place the legs at different angles respective to one another; whereby said slide collar provides means of leveling said stand member along with said base, and a locking device by which said slide collar is removably affixed to said stand member.

5. The lockable leveling structure of claim 1 wherein said stand member provides means of mounting a load bearing fixture thereon; and said structure can thereby compensate for unlevel surfaces, while providing means of supporting loads at predetermined angles.

6. The lockable leveling structure of claim 1 wherein the aperture in said slide collar is of a size to permit said collar to move laterally respective to said stand and thereby provides means to lock said legs in a load bearing configuration to provide a stable load bearing support on an unlevel surface;

said cam member on the near end of said legs is curved and spaced respective to the slot, stand member, and slide collar to bring the outer surface of the slide collar into abutting engagement with the curved near end of the legs and thereby fix the legs into a selected position respective to the stand member, and provide a means of leveling a load carried by the stand member;

said slide collar aperture is of a size significantly larger than said stand member to enable said stand member to be placed vertically respective to the horizon; whereby said slide collar provides means of leveling said stand member along with said base through means of pivoting said legs, and a locking device by which said slide collar is removably affixed to said stand member.

7. A leveling structure by which a load can be supported from a surface in a level altitude, comprising:

a base, a stand member attached to said base and upwardly extending therefrom for carrying a load thereon;

an annular slide collar having a central passageway and an outer abutment surface, said stand member is slidably received in captured relationship through the annular slide collar passageway, fastener means by which said collar is fixed respective to said stand member and base;

a plurality of legs placed circumferentially about said base and having a near end opposed to a far end, said legs extend radially from said base, means pivotally mounting the marginal near end of said legs respective to said base to enable said legs to pivot from a lowermost downwardly extending position into an uppermost stored position where the legs are substantially parallel to said stand; said slide collar passageway is of a size to permit said collar to move laterally respective to said stand and provide means by which said legs are locked in a load bearing configuration, whereby, the near end of said legs pivot into abutting engagement respective to the outer surface of the collar, whereupon said collar is affixed to the stand and thereby fix the legs in a relative position that results in the stand being vertically aligned and thereby provide a stable load bearing support on an unlevel surface.

8. The lockable leveling structure of claim 7 wherein a cam on the near end of said legs is curved and spaced respective to the stand member and slide collar to bring the outer surface of the slide collar into abutting engagement with the curved near end of the leg and thereby fix the legs into a selected position respective to the stand member, and provides means by which a load carried by the stand member can be leveled.

9. The lockable leveling structure of claim 7, wherein said slide collar passageway is of a size significantly larger than said stand member to enable said collar to be laterally displaced respective to the stand member; a locking device by which said slide collar is removably affixed to said stand member.

10. The leveling structure of claim 7 wherein said stand member provides means of mounting a load thereon; whereby said structure can compensate for unlevel surfaces, while providing means of leveling a load supported on the stand member.

11. The lockable leveling structure of claim 7 wherein a cam on the near end of said legs is curved and spaced respective to the stand member and slide collar to bring the outer surface of the slide collar into abutting engagement with the curved near end of the legs and thereby fix the legs into a selected position respective to the stand member, and provides means of leveling a load carried by the stand member;

and a locking device by which said slide collar is removably affixed to said stand member.

12. A leveling device comprising a unitary base, a stand member affixed to said unitary base, a slide collar including a locking device therefor, a passageway through said collar for receiving said stand member therein, a plurality of radially extending legs each having a near end and a far end, a cam at the near end and a support at the far end of each leg, a plurality of radially extending slots in said base, means pivotally attaching one of said legs within respective ones of said slots, said legs having a curved near end;

the curved near end of said legs abut the collar and thereby limit the upward pivotal movement of the legs;

said collar can be telescoped a distance from said base to release the curved end of the legs and thereby enable the legs to pivot in an upward direction into parallel relationship respective to the stand member.

13. The lockable leveling structure of claim 12 wherein the slide collar passageway is of a size to permit said collar to move laterally respective to said stand member and provides means to fix said legs in a load bearing configuration and thereby provide a stable load bearing support on an unlevel surface.

14. The lockable leveling structure of claim 12 wherein said curved end of said legs provides the cam which is spaced respective to the slot, stand member, and slide collar to bring the outer surface of the slide collar into abutting engagement with the curved near end of the legs and thereby fix the legs into a selected position respective to the stand member, and to provide means of leveling a load carried by the stand member.

15. The lockable leveling structure of claim 12 wherein said slide collar passageway is of a size significantly larger than said stand to enable said collar to be placed at a lateral position respective to the stand; said slide collar abuttingly engages the curved near ends of said legs and thereby provides means of leveling said stand member along with said base, and said locking device by which said slide collar is fixed respective to said stand member.

16. The structure of claim 12 wherein said stand member provides means by which a load bearing fixture can be mounted thereto, and said device can compensate for unlevel surfaces, while providing means of supporting loads at any selected angle.

17. The leveling structure of claim 12 wherein the slide collar passageway is of a size to loosely receive and thereby permit said collar to move laterally respective to said stand member and provide means to lock said legs in a load bearing configuration and thereby provide a stable load bearing support on an unlevel surface;

said cam on the near end of said legs is curved and spaced respective to the slot, stand member, and slide collar to bring the outer surface of the slide collar into abutting engagement with the curved near end of the legs and thereby fix the legs into a selected position respective to the stand member, and to provide means of leveling a load carried by the stand member.

* * * * *